US005099628A

United States Patent [19]

Noland et al.

[11] Patent Number: 5,099,628

[45] Date of Patent: Mar. 31, 1992

[54] APPARATUS FOR ENHANCING STRUCTURAL INTEGRITY OF MASONRY STRUCTURES

[75] Inventors: Jimmy L. Noland, Boulder, Colo.; Gary C. Hart, Santa Monica; Robert E. Englekirk, Pacific Palisades, both of Calif.

[73] Assignee: STT, Inc., Boulder, Colo.

[21] Appl. No.: 441,755

[22] Filed: Nov. 27, 1989

[51] Int. Cl.[5] ..... E04B 2/00

[52] U.S. Cl. ..... 52/426; 52/442; 52/562

[58] Field of Search ..... 52/441, 442, 434, 439, 52/415, 426, 562, 565, 293

[56] References Cited

U.S. PATENT DOCUMENTS

| | | | |
|---|---|---|---|
| 1,343,926 | 6/1920 | Madsen . | |
| 3,059,380 | 10/1962 | Holsman | 52/442 X |
| 4,107,895 | 8/1978 | Legrady | 52/426 X |
| 4,337,605 | 7/1982 | Tudek | 52/426 X |
| 4,594,830 | 6/1986 | Matz et al. . | |
| 4,742,659 | 5/1988 | Meilleur | 52/562 X |

FOREIGN PATENT DOCUMENTS

| | | | |
|---|---|---|---|
| 339849 | 4/1936 | Italy | 52/439 |

OTHER PUBLICATIONS

"Proceedings of the Fourth North American Masonry Conference", Aug. 16-19, 1987.

*Primary Examiner*—David A. Scherbel
*Assistant Examiner*—Creighton Smith
*Attorney, Agent, or Firm*—Harold A. Burdick

[57] ABSTRACT

A masonry structure reinforcing and confinement apparatus is disclosed for enhancing the structural integrity under stress of masonry structures formed of a plurality of stacked masonry units. The apparatus includes a plurality of interconnected reinforcing members and is positionable between adjacent surfaces of tiers, or courses, of masonry units so that some members extend between the opposite walls of the masonry units with selected portions of the apparatus being secured in the horizontal mortar joint thereat.

20 Claims, 2 Drawing Sheets

APPARATUS FOR ENHANCING STRUCTURAL INTEGRITY OF MASONRY STRUCTURES

FIELD OF THE INVENTION

This invention relates to masonry reinforcement and, more particularly, relates to apparatus for reinforcement and confinement of materials in masonry structures including a plurality of masonry units.

BACKGROUND OF THE INVENTION

One goal of modern structural design of masonry buildings and other masonry structures is to ensure that critical structural elements will withstand environmentally induced stresses without, or with limited, structural failure (that is, that the structural elements will perform in a ductile, rather than a brittle, manner). In masonry structures, including for example a plurality of stacked masonry units such as bricks, blocks, or the like bonded together with mortar and having grout and vertical reinforcing steel positioned through openings through the masonry units, critical structural elements include shear walls, columns, and beams. These elements may be subjected to high compressive stresses during earthquakes, wind storms and the like, and are prone to brittle and sudden failures which may, in turn, lead to structural collapse. The purpose of confinement reinforcement is to increase the ductility of masonry structural elements by preventing the rapid, brittle failure of unconfined masonry under compression.

A requirement for masonry confinement reinforcement has been incorporated into the 1988 edition of the *Uniform Building Code* (UBC) in Section 2412(d) which provides that a "boundary member" is required in the boundaries of shear walls when specified levels of masonry compressive stress will be exceeded. A boundary member must include confinement in the form of #3 bars at a maximum spacing of eight inches or an equivalent thereto.

A brief description of the mechanics of compression failure of masonry units will clarify the function of, and necessity for, confinement reinforcement. When subjected to compressive stresses, unconfined masonry materials respond by shortening in the direction of the compressive stresses and expanding laterally perpendicular to the direction of the compressive stress. A compression failure occurs when the tensile stresses in the masonry structure generated by the lateral expansion of the structure exceed the tensile strength of the grout, the masonry unit outer walls, or faceshell, and/or the bond between the grout and the faceshell, and is characterized by cracks that propagate parallel to the direction of the compressive stress. This type of failure is very brittle, and results in a sudden and substantially complete loss of load-carrying capacity of the failed masonry unit. In masonry structures having vertical reinforcement bars through the spaces, or cells, of masonry units at selected intervals, further loss of structural integrity may occur following the compression failure of the masonry when the vertical reinforcing bars buckle due to the loss of lateral confinement provided by the grout and masonry unit faceshells.

It would thus be desirable to provide masonry confinement reinforcement which is readily installable at the horizontal mortar joints between tiers of masonry units without requiring appreciable change of mortar joint construction to meet applicable cover requirements specified in applicable building codes. Such masonry confinement reinforcement, when properly configured as set forth hereinafter, will withstand and so reduce lateral expansion of the masonry when placed under stress, thus distributing loading and decreasing the tensile stresses in the masonry units and thereby the possibility of brittle failure, and will, after the maximum compressive strength has been reached, act to hold masonry materials together thus limiting the unchecked propagation of cracks in the masonry and the buckling of vertical reinforcing bars.

In this way masonry materials under compression will maintain some residual strength beyond the maximum strength of the materials, thus continuing to absorb energy well beyond the point where an unconfined masonry would have lost all its strength. If compression failure does occur it is thereby confined to small, localized regions. Thus, the overall ductility of the structural materials, and therefore the structure, is improved. Such reinforcement and confinement would meet or exceed the requirements of equivalence to the UBC specified masonry confinement reinforcement discussed above while, by providing a prefabricated unit, resulting in labor, and thus overall cost, savings to builders.

SUMMARY OF THE INVENTION

This invention provides an improved apparatus for enhancing the structural integrity under stress of structures which include, in combination with other materials, a plurality of stacked building units such as bricks, blocks or other such masonry units having first and second walls with at least a first space defined through the masonry unit between the walls. The apparatus is installable by a mason or other artisan with minimum difficulty and expenditure of time, and includes a plurality of spanning members having a length sufficient to extend from the first wall to the second wall of the building units and including first and second end portions positionable adjacent to different ones of the first and second walls of the building units, at least some of the end portions of the spanning members each having a section forming an elongated interstice. Retaining means, preferably first and second retaining members, are provided with the first retaining member connected to the plurality of spanning members at the second end portions thereof and with the second retaining member connected between the first and second end portions thereof.

The interstice formed in the selected end portions of the spanning members is formed by a hook configuration including a substantially linear end part so that when the selected end portions are positioned adjacent to one of the walls of the building unit the substantially linear end part and the interstice terminate adjacent to the spaced defined through the building unit and spaced from the wall. Providing additional return length of the end parts of the hooked configuration of the selected end portions of the spanning members has been shown to be desirable to assure that deformation of the hooked end portion when the masonry is placed under compressive stress, and thus the potential for disengagement thereof from the horizontal mortar joint between building units, is minimized.

The apparatus is formed of material preferably having a tensile strength of at least about 70,000 psi and a modulus of elasticity $29 \times 10^6$ psi and the spanning members and retaining members are connected so that a substantially constant overall thickness of the apparatus is maintained. The interconnection of the spanning members and the retaining members is preferably such that a network of rectangular structures is established adjacent to the first end portions of the spanning members and spaced from the hooked end portions of the spanning members, and so that vertical reinforcement rods which may be positioned in the masonry structure have two spanning members and part of a retaining member positioned adjacent thereto when the apparatus is positioned for utilization on the building units.

It is therefore an object of this invention to provide an improved apparatus for enhancing the structural integrity under stress of structures formed of a plurality of stacked building units.

It is another object of this invention to provide an improved apparatus for enhancing the structural integrity of structures which is installable by a workman with minimum difficulty and expenditure of time.

It is another object of this invention to provide an improved apparatus for enhancing structural integrity of structures which reduces lateral expansion of masonry units placed under a compressive stress and acts to hold masonry materials together after maximum compressive strength of such units has been reached.

It is another object of this invention to provide an improved apparatus for enhancing structural integrity of structures which provides means for confining vertical reinforcement bars in masonry structures which have reached maximum compressive stress to thus inhibit buckling of such reinforcement bars.

It is still another object of this invention to provide an apparatus for enhancing structural integrity under stress of structures which include, in combination with other materials, a plurality of stacked building units such as bricks, blocks, or other such masonry units having first and second walls with at least a first space defined through the masonry unit between the walls, the apparatus including a plurality of spanning members having a length sufficient to extend from the first wall to the second wall of the building unit and including first and second end portions positionable adjacent to different ones of the first and second walls of the building unit, at least some of the end portions of the spanning members each having a section forming an elongated interstice, and retaining means connected to the plurality of spanning members to maintain the spanning members in a preselected spaced relationship relative to one another.

It is yet another object of this invention to provide an apparatus for enhancing structural integrity of structures wherein a plurality of spanning members are provided having end portions with a hooked configuration including a substantially linear end part, such end parts being positioned adjacent to one of the walls of the building units so that the substantially linear end part terminates adjacent to a space defined through the building units and spaced from the wall.

It is another object of this invention to provide an apparatus for enhancing structural integrity of structures including a plurality of masonry units, the apparatus including a plurality of spanning members having hooked end portions, the plurality of spanning members being connected to retaining members having a length greater than the length of an individual masonry unit, the spanning members being connected to one retaining member at the ends opposite the hooked end portions of each spanning member and being connected to another retaining member between the ends opposite and the hooked end portions of each spanning member.

It is another object of this invention to provide an apparatus for enhancing structural integrity of structures which includes a plurality of interconnected members made of material, preferably steel, having a tensile strength of at least about 70,000 psi, and with the various members being connected so that a substantially constant overall thickness of the apparatus is maintained.

With these and other objects in view, which will become apparent to one skilled in the art as the description proceeds, this invention resides in the novel construction, combination and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
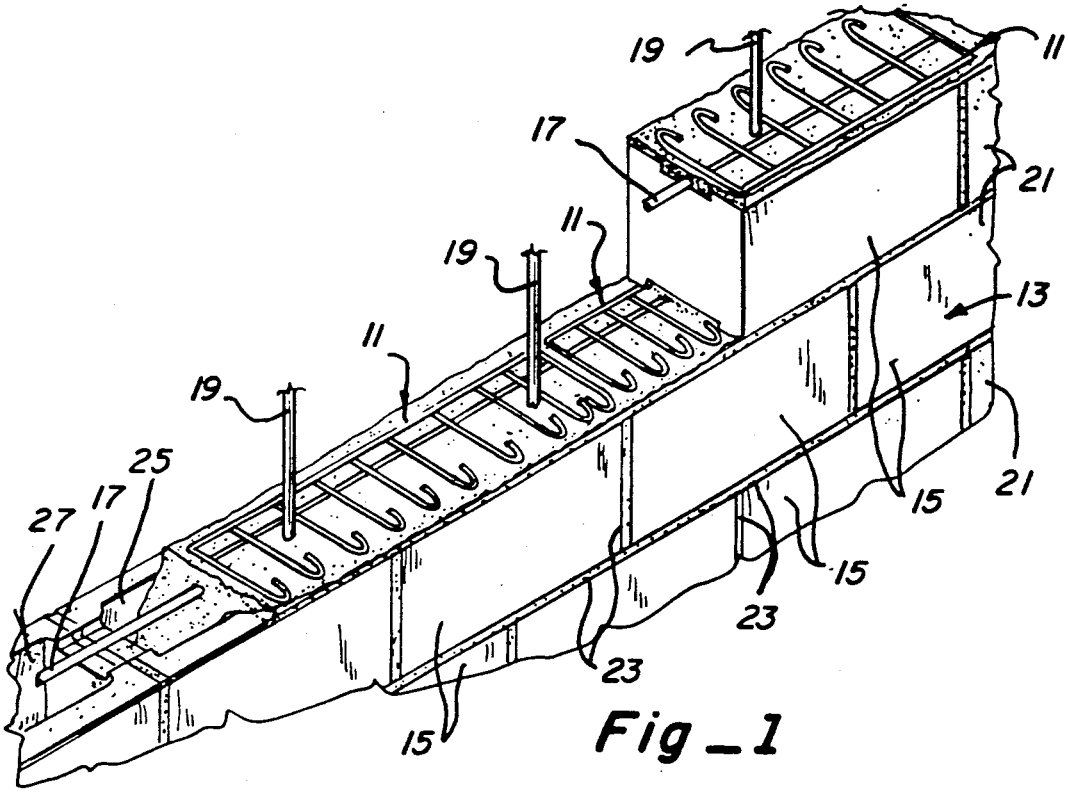
FIG. 1 is a perspective view of the apparatus of this invention positioned on a structure.

A plurality of apparatuses 11 are shown in FIG. 1 installed on a masonry structure 13 including a plurality of building units 15 (herein shown are a plurality of bond beam masonry units, it being understood that the apparatus of this invention may be used in association with a variety of known hollow building units), horizontal reinforcing rods 17 and vertical reinforcing rods 19. The masonry structure shown in FIG. 1 is formed by positioning masonry units 15 end to end forming tiers 21 of such units, with the tiers being stacked and bonded, both vertically and horizontally between units, at mortar joints 23. Cells 25 and 27 of each masonry unit are grouted utilizing known grout mixtures.

Figure 5:
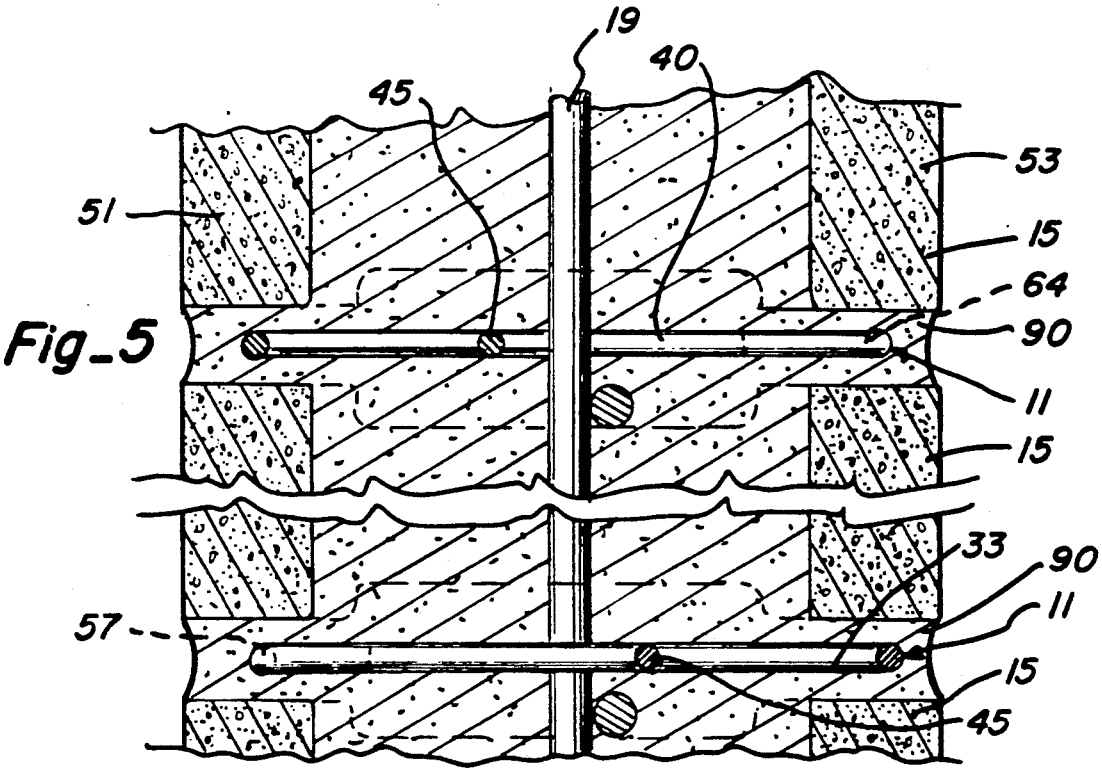
FIG. 5 is a sectional view taken through section lines 5—5 of FIG. 4.

As may be appreciated by reference to both FIGS. 1 and 5, apparatus 11 are oppositely oriented from one course, or tier, of units to the next.

Figure 4:
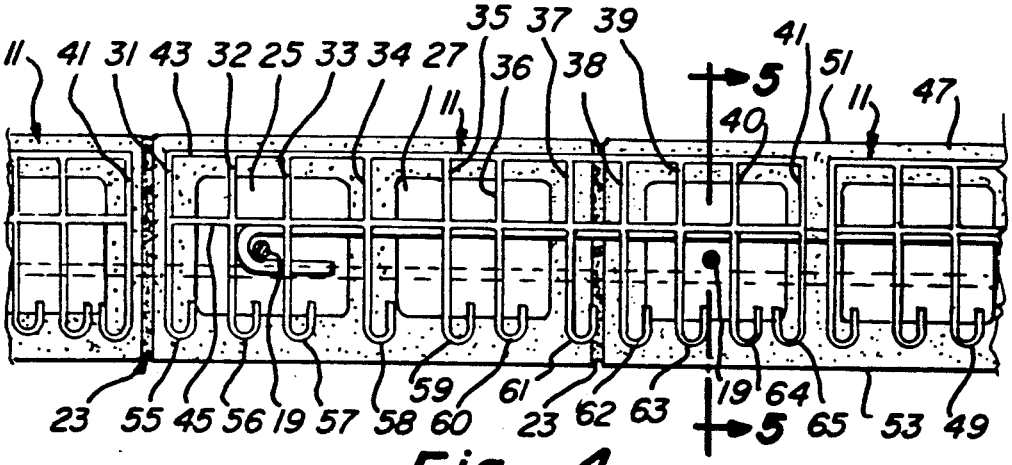
FIG. 4 is a top plan view illustrating positioning of the apparatus of this invention on a tier of masonry units of a masonry structure.
Figure 2:
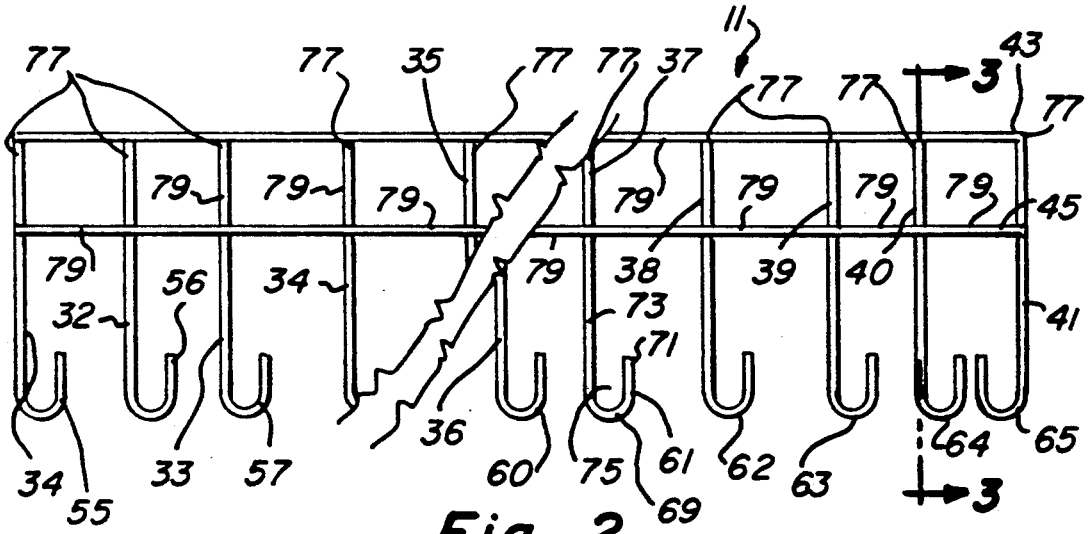
FIG. 2 is a top plan view of the apparatus of FIG. 1.
Figure 3:
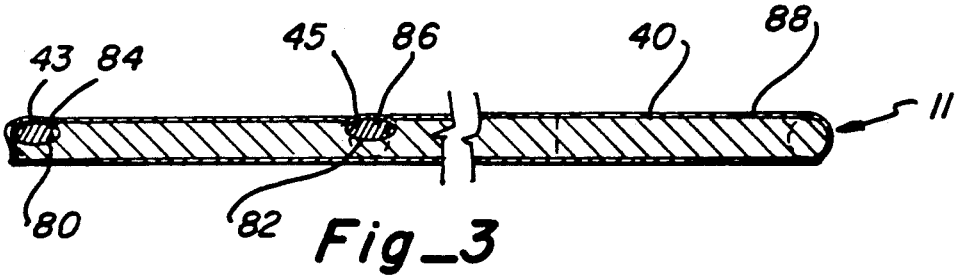
FIG. 3 is a sectional view taken through section lines 3—3 of FIG. 2.

FIGS. 2 through 4 provide a more detailed view of apparatus 11, the apparatus including a plurality of spanning members 31 through 41 and first and second retaining members 43 and 45. Spanning members 31 through 41 are of a length sufficient to extend between stacking surfaces 47 and 49 of outer walls 51 and 53 and retaining members 43 and 45 have a length greater than the length of one masonry unit, preferably about one and one-half times the length of a single masonry unit.

Spanning members 31 through 41 each include a hooked, or anchoring, section 55 through 65, respectively, with spanning members 31 and 41 having their hooked sections inwardly disposed (oppositely oriented relative to one another). Utilizing hooked section 61 by way of example, it being understood that all hooked sections 55 through 65 are similarly configured, each hooked section includes an arcuate part 69 and a substantially linear end part 71 formed at the end of elongated portion 73 of each spanning member. Elongated interstice 75 is thus formed between end part 71 and elongated portion 73 of the spanning members. End part 71 should extend a minimum of one inch from arcuate part 69, it having been found during extensive testing that the additional return length of the end part is desired to assure prevention of dislodgement of the hooked sections from the horizontal mortar joints when the masonry structure is placed under compressive stress (by, for example, straightening of arcuate part 69).

Spanning members 31 through 41 are connected to retaining members 43 and 45 with retaining member 43 being connected at ends 77 of each of the spanning members and with retaining member 45 being connected between ends 77 and hooked sections 55 through 65 of the spanning members but nearer end 77 than to arcuate parts 69 of each of the hooked sections. In this manner, a network of substantially rectangular structures 79 are formed which, when positioned on a tier of masonry units form a closed wire network adjacent to one of the walls and to the spaces in masonry units 15.

Spanning members 31 through 41 and retaining members 43 and 45 are made of smooth steel wire having a minimum tensile strength of about 70,000 psi with the wire having a maximum size of about 3/16 of an inch in diameter and an minimum size of about 0.148 inches in diameter. The wire should otherwise conform with the properties and standards given in the American Society for Testing and Materials (ASTM) A 82-79. In connecting the various members the provisions of the American Welding Society "Reinforcing Steel Welding Code" (AWS D12.1-75) should be followed.

As shown in FIG. 3, the connections between spanning members 31 through 41 and retaining members 43 and 45 are preferably made so that a substantially constant overall planar configuration, and thus a substantially constant overall thickness, of the finished apparatus is obtained. This may be done, for example, by a flattening of either the welded points of connection between members or by an initial preforming of the points of connection between members to provide indentations 80 and 82 in the spanning members and ovate cross sections 84 and 86 in retaining members 43 and 45 thereat.

Apparatus 11 is then preferably hot dipped galvanized following the guidelines set out in the American Society For Testing and Materials designation 17-153, Class B-2 "Specification For Zinc Coating (Hot Dip) On Iron And Steel Hardware", thus providing a zinc coating 88 over the apparatus.

As illustrated in FIG. 4, spanning members 31 through 41 and retaining members 43 and 45 are connected so that at least two of the spanning members will lie adjacent to each of the spaces 23 and 25 through the masonry units, with such adjacent spanning members (for example spanning members 32 and 33, 35 and 36, or 39 and 40) being preferably connected to the retaining members approximately two inches apart. In this manner, vertical reinforcement rods 19 are surrounded on at least two sides by spanning members (for example 32 and 33) and on a third side by a portion of retaining member 45. As shown in FIG. 5, when apparatuses 11 are installed oppositely (with the hooked section on different sides adjacent different ones of walls 51 and 53 in alternating courses), vertical reinforcing rods 19 are thus confined between spanning members and portions of retaining member 45 on all four sides of the reinforcement rod thus providing confinement against buckling of the reinforcement rod in case of failure of the masonry units adjacent thereto.

The apparatus is configured so that at least one spanning member will lie adjacent to the vertical mortar joints between masonry units (for example, in FIG. 4 spanning members 37 and 38) and so that hooked sections 55 through 65 and retaining member 43 are bonded in horizontal mortar joints (90 in FIG. 5) between adjacent masonry units, with hooked sections 55 through 65 being completely covered by mortar at the joint on all sides and, preferably, by grout within the individual spaces in the masonry units. The combination of the hooking action against mortar and grout filling interstices 75 and the network of closed wire rectangular portions is felt to provide particularly efficient resistance to lateral expansion of the masonry unit when the structure, and thus the unit, is placed under a compressive stress such as might be found in an earthquake or high wind conditions.

Apparatus 11 may be constructed to accommodate a variety of sizes and design of masonry units, such units typically having a width of 6, 8 or 12 inches (apparatus 11 in such cases having a width between the arcuate sections 69 and end section 77 of the spanning members of about 4 ⅝ inches, 6 ⅜ inches or 10 ⅛ inches, respectively). Apparatus 11, when constructed to overlie 1 ½ masonry units (a typical unit, for example, being about 16 inches long), would have a length of about 16 inches (1 foot 11 3/16 inches being preferable). It should be understood, however, that the apparatus may be manufactured in 15 sizes to accommodate masonry materials utilized and/or overall desired span.

As may be appreciated from the foregoing, this invention provides a masonry structure reinforcing and confinement apparatus which will enhance the structural integrity under stress of masonry structures formed of a plurality of stacked masonry units, which is simple to install and which will facilitate resistance to lateral expansion of masonry units placed under compressive stresses thus reinforcing the units against such stresses. The apparatus serves to confine vertical reinforcement rods so that, when maximum compressive strength of a masonry unit is reached, buckling of such reinforcement rods is inhibited. In this manner masonry units will maintain some residual strength when placed under compression beyond the maximum strength of unreinforced units and thus continue to absorb energy beyond the point where such masonry units would normally have structurally failed.

What is claimed is:

1. An apparatus for enhancing structural integrity under stress of structures, the structures including a plurality of stacked building units, each building unit including spaced first and second walls and at least a first space defined through said building unit between said walls, said apparatus comprising:

a plurality of spanning members, each one of said spanning members having a length sufficient to extend from said first wall to said second wall of said building units and each of said spanning members including first and second end portions positionable adjacent to different ones of said first and second walls of said building units, at least one of said end portions of each of said spanning members having a second forming an elongated interstice; and retaining means connected to said plurality of spanning members between said first and second end portions thereof so that said plurality of spanning members are maintained in a selected spaced relationship relative to one another.

2. The apparatus of claim 1 wherein said walls of said building units each include upper and lower stacking surfaces adjacent to said space, with adjacent stacked units being bonded at mortar joints between said upper stacking surfaces and said lower stacking surface of said adjacent stacked units, and wherein said sections forming elongated interstices include an arcuate part and an end part, said end part extending a minimum of one inch from said arcuate part.

3. The apparatus of claim 2 wherein said end part is substantially linear thus forming an elongated hooked configuration at said at least some of said end portions of said spanning members.

4. The apparatus of claim 1 wherein said spanning members and said retaining means are made of steel wire having a diameter of no greater than about three sixteenths of an inch and a tensile strength of at least about 70,000 psi.

5. The apparatus of claim 1 wherein said retaining means includes a plurality of retaining members at least one of which is connected to said spanning members between said first and second end portions thereof, said retaining members and said spanning members being connected to form a network of substantially rectangular structures adjacent to one of said end portions of said spanning members and spaced from said sections forming said elongated interstices.

6. The apparatus of claim 1 wherein said retaining means and said spanning members are connected so that said retaining means and spanning members are maintained in a substantially planar relationship relative to one another, said spanning members having linear portions between said end portions which are maintained substantially parallel to each other, at least some of said linear portions being positionable over said first space through said building units.

7. An apparatus for enhancing structural integrity under stress of structures, the structures including a plurality of stacked masonry units, each masonry unit including first and second walls and at least a first space defined through said masonry unit between said walls, said apparatus comprising:

a plurality of spanning members each having a length sufficient to extend from said first wall to said second wall of said building units and including first and second end portions positionable adjacent to different ones of said first and second walls of said building units, at least said first end portions of said spanning members each having a hooked configuration including a substantially linear end part and an elongated interstice so that when positioned adjacent to one of said walls of said masonry unit said end part and said interstice terminate adjacent to said space defined through said masonry unit and spaced from said wall; and first and second retaining members, said first retaining member connected to said plurality of spanning members at said second end portions thereof and said second retaining member connected between said first and second end portions thereof, said retaining members and said spanning members being connected so that a substantially constant overall thickness of said apparatus is maintained.

8. The apparatus of claim 7 wherein said spanning members and said retaining members are made of smooth steel wire, and wherein said apparatus includes a zinc coating.

9. The apparatus of claim 7 wherein at least some of said spaces in said masonry units have vertical reinforcement rods positioned therethrough and wherein said second retaining member and said spanning members are connected so that when said apparatus is positioned adjacent to said masonry units at least some of said vertical reinforcement rods have two of said spanning members and a part of said second retaining member adjacent thereto.

10. The apparatus of claim 9 wherein said walls of said masonry units each include upper and lower stacking surfaces adjacent to said space, and wherein said first and second retaining members and said spanning members are connected to form a network of substantially rectangular structures so that when said apparatus is positioned adjacent to said masonry units said network of rectangular structures is adjacent to said spaces through said masonry units with said first retaining member being maintained between an upper and a lower stacking surface of adjacent stacked masonry units.

11. The apparatus of claim 7 wherein said plurality of spanning members include first and second end spanning members connected to opposite ends of said first retaining member and with said hooked configurations of said first end portions thereof being oppositely oriented.

12. The apparatus of claim 7 wherein each of said walls of said masonry units have a length and wherein said first and second retaining members have a length of about 1 ½ times the length of one of said walls.

13. A masonry structure reinforcing and confinement apparatus for reducing tensile stress in masonry units forming a part of a masonry structure and for checking propagation of masonry material deformation, each of said masonry units having a width defined between first and second outer walls and a length defined between first and second ends, said structure being partly formed by horizontal tiers of said units established by laying said units end to end with said tiers being stacked to form an organized structural assemblage of units, said apparatus comprising:

a plurality of spanning members each having a length sufficient to extend from said first wall to said second wall of said masonry units and including first and second end portions positionable adjacent to different ones of said first and second walls of said masonry units, each of said spanning members being formed of material having a tensile strength of at least about 70,000 psi and said first end portions of at least some of said spanning members each including a anchoring section thereat; and first and second retaining members each having a length greater than said length of one of said masonry units, said first retaining member being connected to said spanning members at said second end portions thereof and said second retaining member being connected to said spanning members between said first and second end portions thereof and nearer to said second end portion than to said first end portion.

14. The apparatus of claim 13 wherein said hooked sections include an arcuate part and a substantially linear end part, said substantially linear end part terminating no less than about one inch from said arcuate part.

15. The apparatus of claim 14 wherein said first and second retaining members and said plurality of spanning members are connected to form a network of substantially rectangular structures.

16. The apparatus of claim 13 wherein said retaining members and said spanning members are connected so that a substantially constant overall thickness of said apparatus is maintained.

17. The apparatus of claim 13 wherein said spanning members and said retaining members are made of smooth steel wire, and wherein said first and second retaining members have a length of about one and one-half times the length of said masonry units.

18. The apparatus of claim 13 wherein said plurality of spanning members include first and second end spanning members connected to opposite ends of said first retaining member and with said hooked sections of said first and second end spanning members being oppositely oriented.

19. The apparatus of claim 13 wherein said masonry units each have at least a first space defined through said units between said first and second outer walls, and wherein said plurality of spanning members are connected to said first and second retaining members in a substantially parallel alignment relative to one another so that when said apparatus is positioned adjacent to said masonry units at least two of said spanning members extend between said first and second outer walls over said first space in each of said masonry units, said at least two of said spanning members being spaced about two inches apart.

20. The apparatus of claim 19 wherein said first and second retaining members each have a length of about one and one-half times the length of one of said masonry units, and wherein at least one of said spanning members is connected to said first and second retaining members so that when said apparatus is positioned adjacent to said masonry units said at least one spanning member is positioned adjacent to said ends of adjacent ones of said masonry units.

* * * * *